United States Patent [19]

Song

[11] Patent Number: 4,787,016

[45] Date of Patent: Nov. 22, 1988

[54] LIGHT ATTACHABLE TO A KEY

[76] Inventor: Chang J. Song, 125 15th Ave., Seattle, Wash. 98122

[21] Appl. No.: 13,756

[22] Filed: Feb. 12, 1987

[51] Int. Cl.[4] ..... F21V 33/00

[52] U.S. Cl. ..... 362/116; 362/191

[58] Field of Search ..... 362/116, 109, 191, 200, 362/253; 70/456 R

[56] References Cited

U.S. PATENT DOCUMENTS

| | | | |
|---|---|---|---|
| 3,085,149 | 4/1963 | Giwosky | 362/116 |
| 3,310,668 | 3/1967 | Schwartz | 362/116 |
| 4,085,315 | 4/1978 | Wolter | 362/116 |
| 4,276,582 | 6/1981 | Burnett | 362/116 |
| 4,303,966 | 12/1981 | Wolter | 362/116 |
| 4,392,186 | 7/1983 | Cziment | 362/116 |
| 4,521,833 | 6/1985 | Wolter | 362/116 |

*Primary Examiner*—Michael Koczo
*Assistant Examiner*—D. M. Cox
*Attorney, Agent, or Firm*—Townsend & Townsend

[57] ABSTRACT

An improved light attachable to a key is provided with a housing and back plate having substantially similar widths between which is secured the head portion of a key. The housing encases a frame formed with recesses to accept a battery, light bulb, contacts and a switch. The frame fits into the back side of the housing such that a flat back side is formed which allows the head of a key which abuts the back side of the housing to overhang the width of the housing. The back plate attaches to the housing by means of a rectangular tab on one edge of the back plate which engages a correspondingly shaped groove in the housing, and by means of a screw from the face of the housing through a hole in the head of the key to the face of the back plate. The back plate is formed so as to have three open sides to similarly allow the head of the key to overhang its width. The key is held in place by the clamping force between the housing and the back plate provided by the screw, and also adhesive material disposed on the back plate to affix the key head to the back plate. Optionally, a bore is provided in the housing and frame to receive and carry a screwdriver used to tighten or remove the screw.

15 Claims, 1 Drawing Sheet

LIGHT ATTACHABLE TO A KEY

BACKGROUND OF THE INVENTION

1. Field of the Invention

The present invention relates generally to portable lighting devices, and more specifically to a portable lighting device which may be attached to a key having a head of any width.

2. Description of the Prior Art

Lighting devices which attach to keys are well known in the art. For example, U.S. Pat. No. 4,085,315, issued Apr. 18, 1978, and U.S. Pat. No. 4,303,966, issued Dec. 1, 1981, both to Wolter, show such devices. Both of the patents to Wolter show a housing receiving an incandescent bulb, battery, battery cover and spring. The lamp operates when the battery, by way of the battery cover, is depressed against the urging of the spring so as to engage a contact, thus completing the circuit between the battery and the bulb.

Both of the above-mentioned patents to Wolter also disclose a light attachable to a key in a manner, by design, which limits the width of the key head to which the light may be attached.

An additionally significant limitation of the above-mentioned two lights is that the body of the key light extends wider than the width of the key head.

There is a need for a light attachable to a key which accepts a wide variety of key widths, is of a narrow construction for allowing use with most automobile ignition locks, which is sufficiently strong to resist twisting forces which would tend to separate the light and the key, and which provides means to maintain the focus of light para11el with the axis of the key. It is an object of the present invention to provide each of these features in a light attachable to a key, as well any and all other objects enumerated in the present application.

SUMMARY OF THE INVENTION

The present invention provides a light attachable to a key having virtually any width head. The key head is clamped between a housing a back plate which are held together by a screw or similar securing device. Supplementing the clamping force between the housing and backplate to hold the key in place is a section of self-adhesive material located between the back plate and key. The housing surface and back plate which engage the key are planar and open on all but one side, thus allowing the key head to overhang three edges of the light. The back plate has a raised shoulder at one end for engaging the top- most portion of a key head. Extending out from the shoulder on the back plate is a notch which fits into a complementary shaped groove in the housing when the light is assembled. This notch and groove combination assists in preventing unwanted rotation of the key out of alignment with the beam of the light.

The internal workings of the light comprise an internal frame which is fitted into a recess in the housing. The frame has recesses for receiving a battery, bulb, switch and internal connections. The switch is of the push button temporary contact type and in one embodiment extends through the upper surface of the housing. A continuous contact is established between one terminal of the battery and one terminal of the bulb. A second terminal of the battery is connected to a contact secured to the frame and held proximate to, but not in touching contact with, the second terminal of the bulb. That portion of the contact proximate to the second terminal of the light bulb is biased against the actuator of the push button switch. When the actuator is depressed the contact is brought into touching engagement with the second terminal of the light bulb, which completes the circuit, and illuminates the light.

In one embodiment of the present invention, a screw driver is provided for operating the screw securing device. The screwdriver is carried in a recess provided in the housing such that when installed in the recess the head of the screwdriver is flush with one side of the housing. A biased retaining tab is provided in the internal frame which engages a portion of the screwdriver when the screwdriver is disposed in the recess for holding the screwdriver in place. Provision of such a screwdriver allows convenient and quick installation of the light onto the key head, removal of the light from the key head, and tightening of the screw securing means.

In a preferred embodiment of the present invention an eyelet of large diameter is provided to allow installation of the light into a wide variety of key carrying chains and rings. Further, the housing back plate and switch actuator are fabricated of a metal. such as aluminum, for greater durability.

These and other features of the present invention will become readily apparent from the following detailed description, taken with reference to the figures of the accompanying drawings.

DETAILED DESCRIPTION OF THE PREFERRED EMBODIMENT

Figure 1:
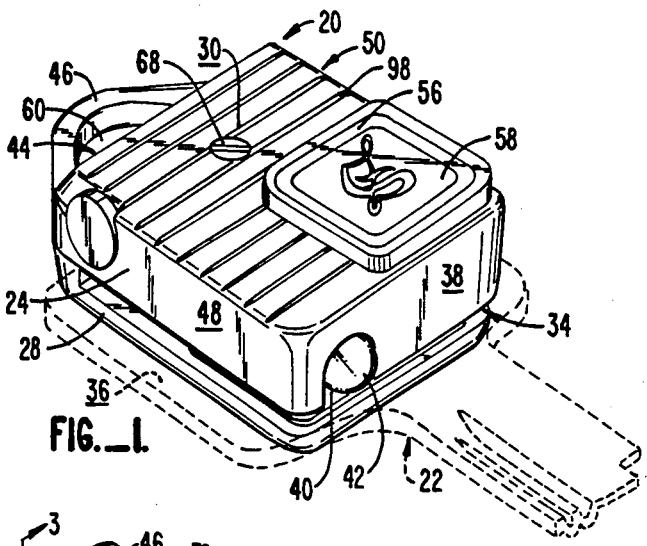
FIG. 1 is a perspective view of an assembled light according to the present invention attached to a key.
Figure 2:
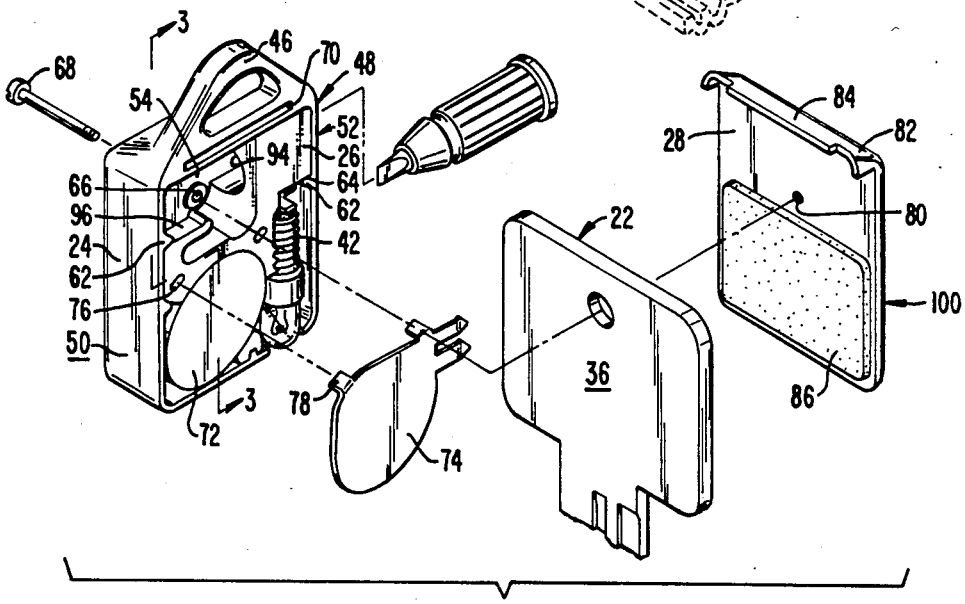
FIG. 2 is a perspective exploded view of a light attachable to a key according to the present invention showing internal detail and assembly of the light.

Referring to FIG. 1, a perspective view of an assembled light 20 attached to a key 22 according to the invention of the present application is shown. The light 20 comprises a housing 24 a frame 26 and a back plate 28.

Housing 24 is preferably rectangular in shape. It has a front surface 30 on which a switch 32 for operating the light is positioned. Housing 24 has a back surface 34 which abuts the head 36 of a key 22 when the light is installed on the key 22. The housing 24 has a bottom edge 38 having a bore 40 therethrough from which a light bulb 42 protrudes. Bore 40 in bottom edge 38 is sized to allow the tip of a light bulb 42 to protrude therethrough. Bore 40 in a preferred embodiment is U-shaped, positioned so that the bottom edge 38 is open at the point where the bore 40 on bottom edge 38 meets the back surface 34. Housing 24 further has a top edge 44 from which a key chain eyelet 46 extends, and two side edges 48 and 50 one of which has a bore 52, in a preferred embodiment, for receiving a screwdriver. The key chain eyelet 46 is preferably an arch-shaped member extending from one side edge 48 to the other side edge 50, with a hollow passage 60 for accepting a key chain therethrough. Front surface 30 is provided with a bore 56 for receiving an actuator 58 of switch 32. In a preferred embodiment the bore 56 and actuator 58 are square- shaped and sized so as to allow depressing of the actuator 58 by a user's thumb or fingertip.

Housing 24 is provided with a means 66 for receiving securing means 68 to secure key 22 between housing 24 and back plate 28. In a preferred embodiment securing means 68 comprises a screw, and means 66 comprises a recessed bore for receiving the head of the screw such that the head lies flush with front surface 30 of housing 24.

The back surface 34 of housing 24 is opened to present the cavity 54 for receiving a frame 26. In a preferred embodiment, cavity 54 has a plurality of ribs 62 running between the front surface 30 and the back surface 34 of housing 24. These ribs 62 engage corresponding channels 64 in frame 26 so as to more effectively secure the frame 26 in the cavity 54.

Frame 26, disposed in cavity 54, defines recesses for receiving a battery 72 a bulb 42 and a plurality of bulb-to-battery contacts 74. The recess in frame 26 for receiving the battery will generally be circular to accept a circular battery, the axis of the recess being perpendicular to the plane of front surface 30. The recess for the bulb 42 preferably has ribbed sides that engage threads on the bulb to better secure the bulb in place. The recesses for the contacts 74 may comprise either channel-like recesses into which the entire contact is fit, or in a preferred embodiment, the recesses comprise one or more rectangular notches into which are fit correspondingly shaped holes 76 located on the contacts 74.

As discussed above, side edge 48 of housing 24 is provided with a bore 52 for receiving a screwdriver. Frame 26, in this embodiment, will have a correspondingly shaped and positioned channel 94 for receiving the screwdriver. Additionally, frame 26 is provided with a biased retaining tab 96 which engages a complementary portion of the screwdriver, when the screwdriver is disposed in the recess, for holding the screwdriver in place.

Back plate 28 is a flat rectangular plate of a size corresponding to that of the housing 24. The back plate is provided with means 80 for receiving securing means 68 to secure the key 22 between housing 24 and back plate 28. In a preferred embodiment, means 80 comprise a circular bore with a helically threaded interior designed to receive the helically threaded end of a screw. Back plate 28 is provided with a raised shoulder 82 at one edge which extends from and perpendicular to the plane of back plate 28. Extending parallel to raised shoulder 82 is tab 84 of a size and shape designed to correspond to the size and shape of channel 70 in housing 24. Back plate 28 is further provided with adhesive material 86 to provide added strength to the clamping force between the housing 24 and back plate 28 exerted on key 22.

Figure 3:
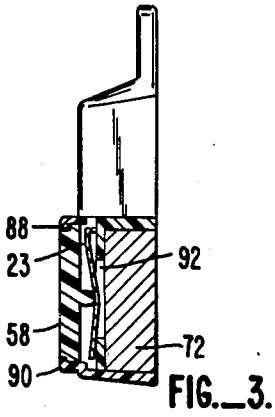
FIG. 3 is a side cut-away view of the housing, showing the frame, battery, contact and switch of the present invention.

Referring in particular to FIG. 3, details of switch 32 are shown. Switch 32 comprises a button-like actuator 58 disposed in corresponding bore 56 in housing 24. Actuator 58 is held in place in bore 56 by a biased contact 72 which biases a flanged collar 88 of the switch actuator 58 against a corresponding shoulder 90 on housing 24. Contact 72 which biases switch actuator 58 is proximate to, but not in touching engagement with, battery 72. Means 92 are provided in the frame 26 to allow touching engagement between the contacts 73 and battery 72 when switch actuator 58 is depressed against the biasing force of the contact 72. When such contact is made a circuit between the battery 72 and light bulb 42 is complete, thus light bulb 42 is illuminated.

The material from which housing 24, frame 26 and backplate 28 are made may vary. In a preferred embodiment of the present invention housing 24 and back plate 28 are fabricated of metallic material such as aluminum or alloy. Also, frame 26 in a preferred embodiment is fabricated of plastic. In other embodiments, the housing 24 and back plate 28 may be of plastic material or frame 26 may be of a metallic material. Likewise, the material from which switch actuator 58 may be fabricated may vary, wherein in a preferred embodiment switch actuator 58 is of a metallic material such as aluminum or alloy other embodiments have switch actuator 58 fabricated of plastic.

To provide improved gripping of the light a plurality of parallel notches or similar contours 98 are provided on front surface 30 of housing 24 and back surface 100 of back plate 28. Generally, notches or contours 98 will extend the width of housing 24 and back plate 28 respectively and in a direction perpendicular to the axis of key 22.

To those skilled in the art to which this invention relates, many changes in construction and widely differing embodiments and applications of the present invention will suggest themselves without departing from its spirit and scope. The disclosure and description herein are purely illustrative and are not intended to be in any sense limiting.

What is claimed is:

1. A key light including a lamp, battery, and switch, for affixing to a variety of standard key heads for engaging a lock mechanism defining a region for receiving the head of the key, the region being of a size substantially equal to the widest radius defined by the key head, comprising:

a housing, open on a first surface for accepting a light assembly, having a bore through a second surface opposite said first surface for accepting a switch actuator, at least one groove located at one end of said housing for accepting a securing means notch, and a first bore through a second end of said housing opposite of said first end for accepting a light bulb, the width of the housing being less than or equal to the width of the standard key head;

securing means, for securing the standard key head to said housing, having a planar region, at least one notch projecting from said planar region for engaging said groove;

a light assembly having a frame with recesses for accepting a battery, light bulb, contacts, and switch means which connect the battery and bulb; and switch means having a plurality of contacts and a switch actuator carried by said housing for actuating the key light.

2. A key light according to claim 1, further comprising said housing having a second circular bore entirely through said second surface of said second surface of said housing and a first circular bore in said planar region of said securing means for accepting a screw fastening means between said second surface of said housing and said planar region of said securing means.

3. A key light according to claim 2, further comprising said housing having a third circular bore disposed in an edge of said housing perpendicular to said second end of said housing, said second circular bore having an axis perpendicular to the axis of said first circular bore, for accepting a screwdriver.

4. A key light according to claim 3, further comprising said light assembly having a biased retaining member for engaging and retaining a screwdriver.

5. A key light according to claim 2, further comprising screw fastening means engaging said second surface of said housing and said planar region of said securing means for securing the key to said housing.

6. A key light including a lamp, battery, and switch for affixing to a standard head of a key, comprising:

a housing, open on a first surface for accepting a light assembly, having a bore through a second surface opposite said first surface for accepting a switch actuator, at least one groove located at one end of said housing for accepting a securing means notch, and a first bore through a second end of said housing opposite of said first end for accepting a light bulb;

securing means, for securing the standard key head to said housing, having a planar region and at least one notch projecting from said planar region for engaging said groove, said securing means being affixed to said housing such that a body is defined having two lateral edge faces and two end edge faces, said two lateral edge faces and one of said end edge faces being partially open to allow the standard head a key to extend therethrough;

a light assembly having a frame with recesses for accepting a battery, a light bulb, contacts, and switch means connecting the battery and bulb, for positioning within the body; and switch means having a plurality of contacts and a switch actuator carried by said housing for actuating the key light.

7. A key light according to claim 6 further comprising said housing having a circular bore entirely through said second surface of said housing and a first circular bore in said planar region of said securing means for accepting a screw fastening means between said second surface of said housing and said planar region of said securing means.

8. A key light according to claim 7, further comprising said housing having a third circular bore disposed in an edge of said housing perpendicular to said second end of said housing, said second circular bore having an axis perpendicular to the axis of said first circular bore, for accepting a screw driver.

9. A key light according to claim 8, further comprising said light assembly having a biased retaining member for engaging and retaining a screw driver.

10. A key light according to claim 7, further comprising screw fastening means engaging said second surface of said housing and said planar region of said securing means for securing the key to said housing.

11. A key light including a lamp, battery and switch, for affixing to a standard head of a key, comprising:

a housing, open on a first surface for accepting a light assembly, having a bore through a second surface opposite said first surface for accepting a switch actuator, at least one groove located at one end of said housing for accepting a securing means notch, and a first bore through a second end of said housing opposite said first end for accepting a light bulb, said housing having a circular bore on a side perpendicular to said first and second ends for accepting a screw driver;

securing means, for securing the standard key head to said housing, having a planar region, and at least one notch projecting from said planar region for engaging said groove;

a light assembly having a frame with recesses for accepting a battery, a light bulb, contacts and switch means which connect the battery and bulb; and switch means having a plurality of contacts and a switch actuator carried by said housing for actuating the key light.

12. A key light according to claim 11, further comprising said light assembly having a biased retaining member for engaging and retaining a screw driver.

13. A key light including a lamp, battery and switch, for affixing to a variety of standard key heads for engaging a lock mechanism defining a region for receiving the head of the key, the region being of a size substantially equal to the widest radius defined by the key head, comprising:

a housing, open on a first surface for accepting a light assembly, having a bore through a second surface opposite said first surface for accepting a switch actuator, at least one groove located at one end of said housing for accepting a securing means notch, and a first bore through a second end of said housing opposite of said first end for accepting a light bulb, the housing being less than the width of the region defined by the lock mechanism for accepting the standard key head, said housing having a circular bore in a side face perpendicular to first and second ends for accepting a screw driver;

securing means, for securing the standard key head to said housing, having a planar region, at least one notch projecting from said planar region for engaging said groove;

a light assembly having a frame with recesses for accepting a battery, light bulb, contacts and switch means which connect the battery and bulb; and switch means having a plurality of contacts and a switch actuator carried by said housing for actuating the key light.

14. A key light according to claim 13 further comprising said light assembly having a biased retaining member for engaging and retaining a screw driver.

15. A key light including a lamp, battery and switch for affixing to the head of a key, comprising:

a right perpendicular prismatic housing, open on a first surface for receiving a light assembly, having:

a plurality of retaining ribs extending the elevation of said opening in and perpendicular to said first surface, for retaining a light assembly, a generally rectangular groove adjacent to said open first surface opening in a similar direction to the direction said first surface opens, a square bore entirely through a second surface opposite said first surface for accepting a switch actuator, a raised lip encircling said square bore disposed on and extending away from said second surface, a flange on said raised lip centrally directed toward the axis of said rectangular bore around the length of the perimeter of the raised lip for retaining a switch actuator, a first circular bore entirely through said second surface of a first diameter for accepting a screw fastening means, a second circular bore of a second diameter greater than said first diameter concentric with said first circular bore and extending part-way through said second surface to provide a flanged means for retaining a screw fastening means, a plurality of parallel notches disposed on said second surface for providing a non-slip surface for gripping, an arched member extending in a direction perpendicular to the axis of and opposite the open first surface from the rectangular groove which defines an eyelet for receiving a key carrying chain, a U-shaped cut-away in a first edge of said housing opposite said arched member said U-shaped cut-away disposed so as to have an open end opening in a direction towards said first surface, for accepting a light bulb, a third circular bore disposed in a second edge of aid housing perpendicular to said first edge of said housing, said third circular bore having an axis perpendicular to the axis of said U-shaped cut-away, for accepting a screwdriver, and a recess in said second edge part way around the lip of the third circular bore for allowing flush mounting of a screwdriver with a flanged head through the third bore;

a lighting assembly having:

a frame which defines integrally a recess for retaining a battery, a ribbed surface adjacent to said recess and opposing a surface of said housing for retaining a light bulb between said ribbed surface and said housing, a notch on a first face of said frame for accepting a retaining tab of a first battery-to-lamp contact, a plurality of notches on a second face of said frame opposite said first face for accepting retaining tabs of a second battery-to-lamp contact, means in said battery recess for allowing touching contact between a battery and a contact arm, a biased retaining member for engaging and retaining a screwdriver, and notches for accepting said retaining ribs for retaining the light assembly in said frame;

a back plate having:

a first planar region, said first planar region having a circular bore disposed entirely therethrough, the axis of said bore being perpendicular to the plane of said first planar region, said bore having helical threading disposed on its inner walls for receiving a screw fastening means, said first planar region further having a plurality of notches disposed parallel to the plane of said first planar region for producing a non-slip grippable surface, a raised shoulder extending in a plane perpendicular to the plane of a said first planar region for providing a rear support for the head of a key, a generally rectangular securing means tab secured to said shoulder and disposed parallel to the plane of said shoulder for engaging said groove located in said housing, and adhesive elements affixed to a face of said first planar region opposite said notches for securing the head of a key to the back plate;

switch means having:

a square switch actuator positioned in said square bore through said second surface of said housing, a first and second bulb-to-battery contact, said first bulb-to-battery contact comprising a bulb contact and a contact arm, said bulb contact being positioned so as to be in continuous contact with a bulb and said contact arm residing proximate to the battery so as to allow a surface of said switch actuator to move said contact arm between a first and second position wherein in said first position said contact arm is proximate to but not in touching contact with the battery, and wherein in said second position said contact arm does touchingly contact the battery through said means in said circular recess, said second bulb-to-battery contact being positioned so as to make continuous contact between a bulb and a battery, and screw securing means, engaging both said housing and said back plate, for securing the key head between said housing and said back plate.

* * * * *